US006719606B1

(12) United States Patent
Mukensturm

(10) Patent No.: US 6,719,606 B1
(45) Date of Patent: Apr. 13, 2004

(54) SOFT SCULPTURE SHELLFISH ANIMAL TOY AND ACCESSORIES

(76) Inventor: Judy Mukensturm, 11479 Patterson Lake Dr., Pinckney, MI (US) 48169

( * ) Notice: Subject to any disclaimer, the term of this patent is extended or adjusted under 35 U.S.C. 154(b) by 0 days.

(21) Appl. No.: 09/903,421

(22) Filed: Jul. 11, 2001

(51) Int. Cl.[7] ..... A63H 3/02

(52) U.S. Cl. ..... 446/369; 446/72; 446/73; 446/76

(58) Field of Search ..... 446/369, 76, 75, 446/74, 73, 72, 71; D21/597

(56) References Cited

U.S. PATENT DOCUMENTS

| | | | | | |
|---|---|---|---|---|---|
| 255,534 | A | * | 3/1882 | Reeve | 446/74 |
| 4,027,423 | A | * | 6/1977 | Barlow et al. | 446/268 |
| D250,941 | S | * | 1/1979 | Rudy | D21/597 |
| D252,807 | S | * | 9/1979 | Schnyderite et al. | D21/597 |
| 4,174,059 | A | * | 11/1979 | Maunder | 446/73 |
| D257,781 | S | * | 1/1981 | Inzerillo et al. | D21/597 |
| 4,322,004 | A | * | 3/1982 | Schwuchow | 446/76 |
| 4,508,512 | A | * | 4/1985 | Girsch et al. | 446/73 |
| 4,715,840 | A | * | 12/1987 | Swift | 446/73 |
| 4,883,442 | A | * | 11/1989 | Kaplan | 446/369 |
| 4,899,881 | A | * | 2/1990 | Girard et al. | 206/457 |
| 4,950,194 | A | * | 8/1990 | Gullace | 446/76 |
| 4,954,114 | A | * | 9/1990 | Kawashima | 446/75 |
| 4,957,786 | A | * | 9/1990 | Barboza | 446/388 |
| 4,964,831 | A | * | 10/1990 | Wolff | 446/75 |
| D313,825 | S | * | 1/1991 | Wyeth | D21/605 |
| 5,064,398 | A | * | 11/1991 | Richardson | 446/75 |
| 5,310,378 | A | * | 5/1994 | Shannon | 446/268 |
| 5,525,088 | A | * | 6/1996 | Mayne | 446/75 |
| 5,540,609 | A | * | 7/1996 | Hoag | 446/369 |
| 5,692,943 | A | * | 12/1997 | Copp | 446/75 |
| D389,701 | S | * | 1/1998 | Cooley | D7/564 |
| D422,037 | S | * | 3/2000 | McLeer et al. | D21/624 |
| D435,610 | S | * | 12/2000 | Kramer | D21/650 |
| D437,012 | S | * | 1/2001 | Crawford | D21/591 |
| 6,176,705 | B1 | * | 1/2001 | Garvey et al. | 446/76 |
| 6,234,863 | B1 | * | 5/2001 | Hughey et al. | 446/369 |
| 6,250,985 | B1 | * | 6/2001 | Nicholson | 446/76 |

FOREIGN PATENT DOCUMENTS

| | | | | |
|---|---|---|---|---|
| FR | 1409814a1 | * | 12/1964 | |
| FR | 2620041 A1 | * | 3/1989 | A63H/3/02 |

* cited by examiner

*Primary Examiner*—Derris H. Banks
*Assistant Examiner*—Urszula Cegielnik
(74) *Attorney, Agent, or Firm*—James M. Deimen

(57) ABSTRACT

A soft sculpture shellfish animal toy comprises a soft sculpture of an oyster accented with features to give it "personality" and "hugability" to children and humor to adults. Such features include hands and feet, a head and eyes. Being an oyster there is a pearl that opens and closes to contain small items that a child might collect. Also, there is an oyster shell that opens and closes to contain the oyster and pearl as well as more items that a child might collect.

9 Claims, 5 Drawing Sheets

SOFT SCULPTURE SHELLFISH ANIMAL TOY AND ACCESSORIES

BACKGROUND OF THE INVENTION

The field of the invention pertains to toys and, in particular, to stuffed toy animals and accessories for the animals.

Stuffed toy animals comprise an almost infinite variety of renderings of animals. Perhaps the most famous stuffed animal toy is the "Teddy Bear." While most stuffed animal toys have been introduced as toys, others have been derived from comic strips such as "Snoopy" from "Peanuts." Programs for adult purposes have also been the source of stuffed animal toys such as "Smokey the Bear" of U.S. Forestry fame.

Movies have been a rich source of characters that lend themselves to stuffed animal toys. The many cartoon characters from Walt Disney Studios and Warner Brothers that have been rendered as stuffed toys attest to the popularity of such toys. But, despite the almost overwhelming plethora of such toys, there is always an opportunity for more stuffed animal toys.

SUMMARY OF THE INVENTION

The new soft sculpture shellfish animal toy comprises a soft sculpture of an oyster accented with features to give it "personality" and "hugability" to children and humor to adults. The oyster toy includes as accessories a variety of accessories, some substantially unique to oysters such as a shell and some merely optional renditions of flotsam and jetsam of the oceans. Of course, being an oyster there is a pearl and the pearl opens and closes to contain small items such as simulated flotsam and jetsam. The shell likewise opens and closes and is sized to contain the oyster toy, pearl and more small items. In addition, to add to its personality the oyster toy can wear a variety of clothing items, most suitable of a nautical variety.

DESCRIPTION OF THE PREFERRED EMBODIMENTS

Figure 1:
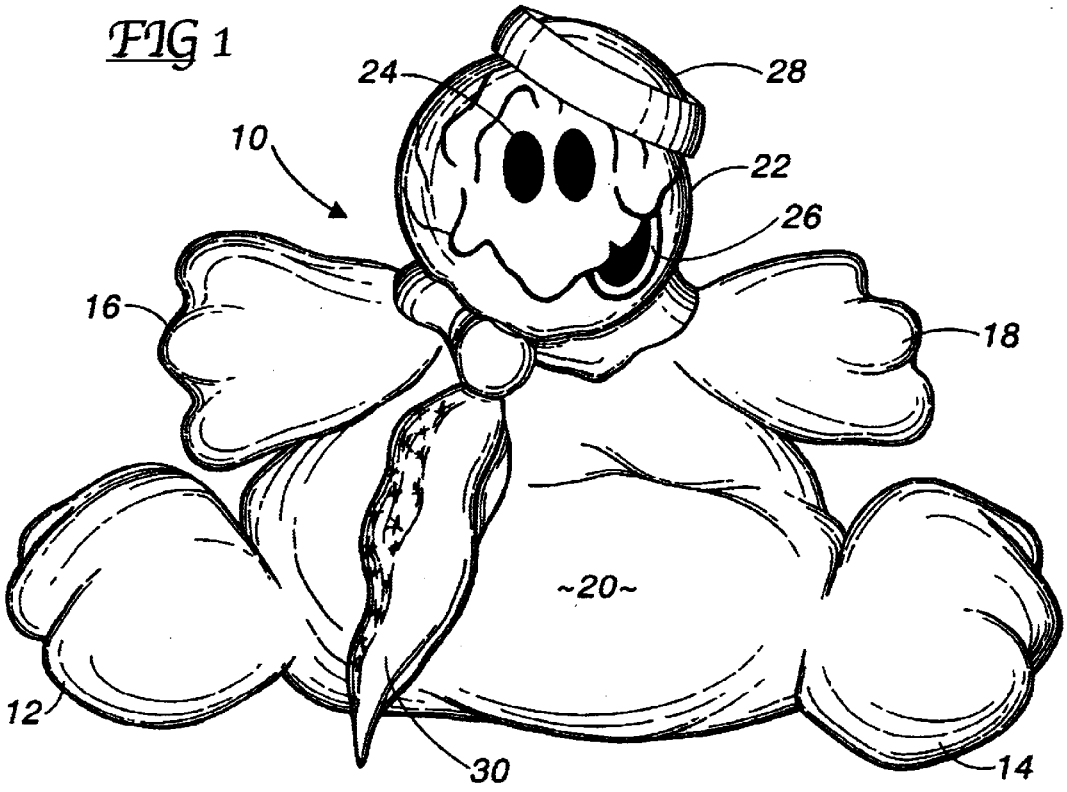
FIG. 1 illustrates the soft sculpture oyster toy from the front.
Figure 2:
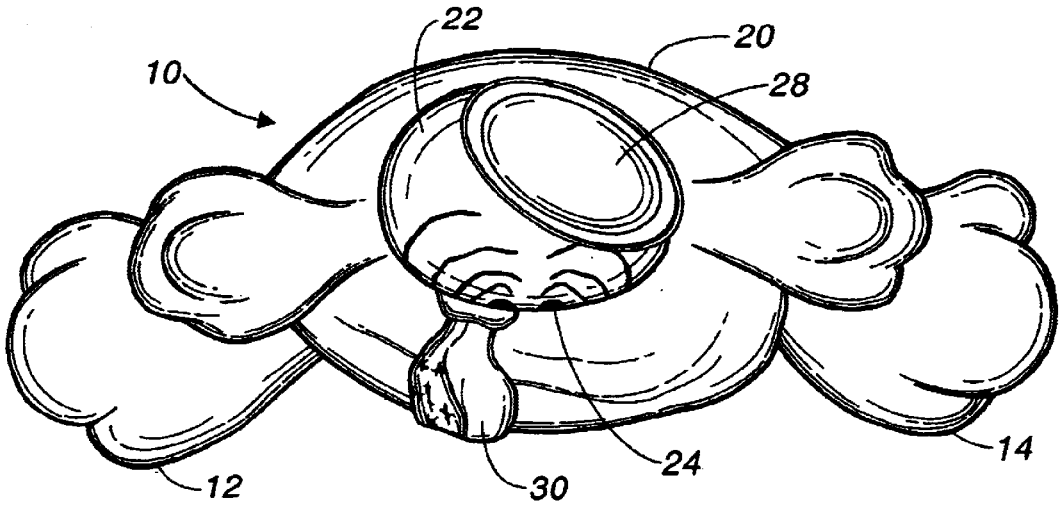
FIG. 2 illustrates the soft sculpture oyster toy from the top.
Figure 3:
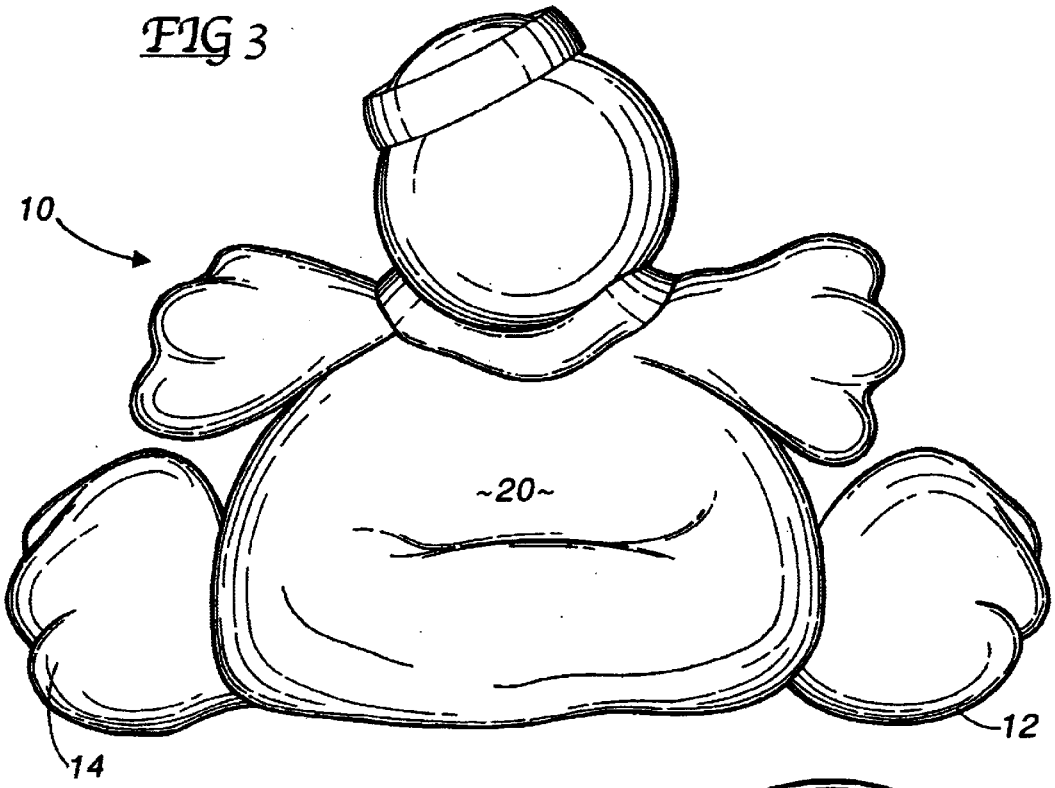
FIG. 3 illustrates the soft sculpture oyster toy from the back.

Illustrated in FIGS. 1, 2 and 3 is the soft sculpture oyster toy animal generally denoted by 10 having features to anthropomorphisize the animal. The features comprise feet 12 and 14 and hands 16 and 18 extending from a body 20. Atop the body 20 is a head 22 with eyes 24, and a mouth 26 with an amusing grin. A sailor's cap and a kerchief 30 with a nautical motif complete the soft sculpture.

Figure 4:
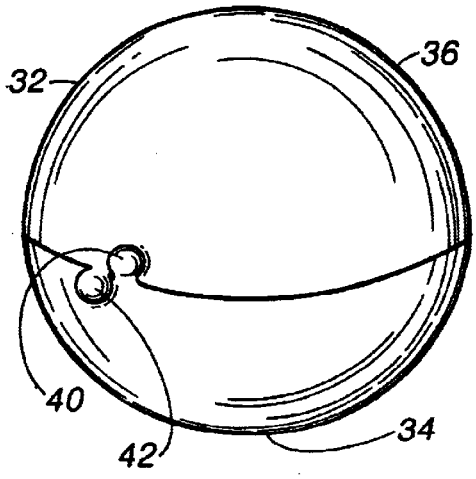
FIG. 4 is a hollow pearl shown closed.
Figure 5:
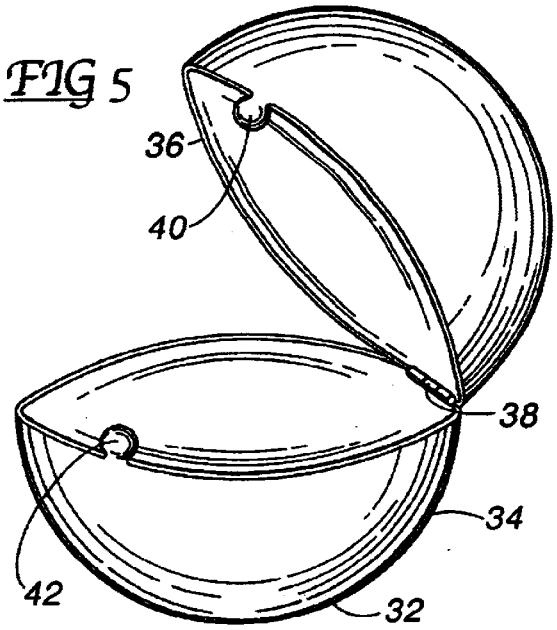
FIG. 5 is the pearl of FIG. 4 shown open.

Accompanying the oyster toy animal 10 is a hollow pearl 32 as shown in FIGS. 4 and 5 and having a lower half 34 and an upper half 36. The pearl halves 34 and 36 are joined by a hinge 38 permanently affixed to the halves. About diametrically opposite the hinge 38 is a simple latch device comprising upper 40 and lower 42 beads integral with the halves. The upper 40 and lower 42 beads are positioned as shown in FIG. 4 to form a slight interference fit in closing or opening the pearl 32 and thereby function as a latch. In contrast to the soft fabric or soft plastic exterior of the oyster toy animal 10, the pearl 32 is made of a hard plastic or similar material to better simulate a real pearl but on a scale considerably larger.

Any number of small items might be placed in the pearl 32 such as coins, jewelry, pins and small pirate flags, pirate caps, and stickers as well as the simulated flotsam and jetsam.

Figure 6:
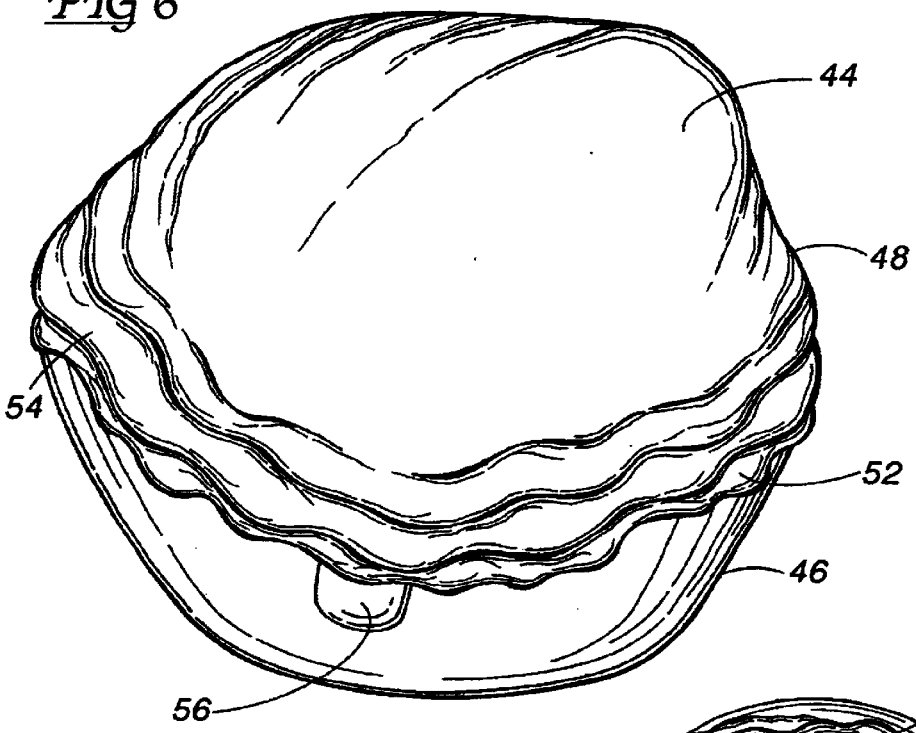
FIG. 6 is a hollow shell shown closed.
Figure 7:
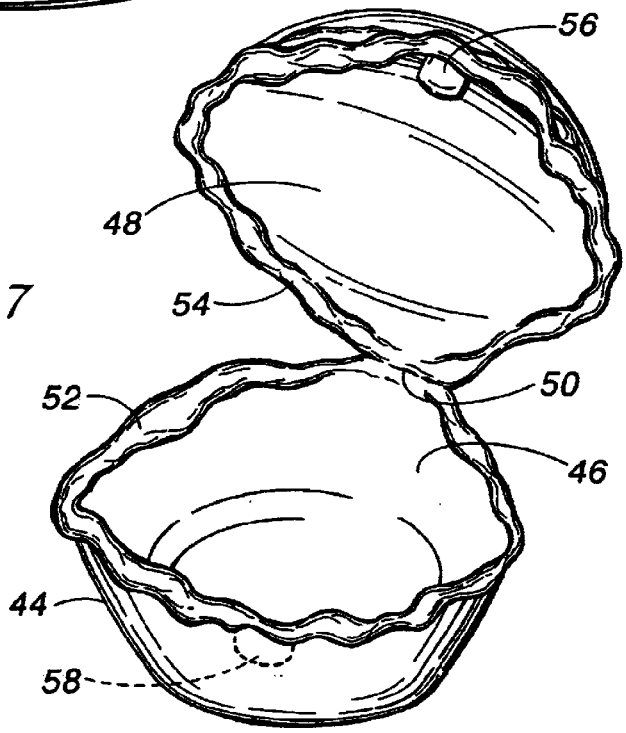
FIG. 7 is the shell of FIG. 6 shown open.

Illustrated in FIGS. 6 and 7 is a shell 44 having a relatively deep lower half 46 and shallow upper half 48. A hinge 50 joins the lower 46 and upper 48 shell halves together. The shell 44 may be constructed with a hard exterior or a semi-soft exterior of very irregular surface shape and with very irregular opening edges 52 and 54 on the lower 46 and upper 48 halves respectively. A tab 56 may be affixed to the upper half 48 to fit through a slot 58 or inside the lower half 46 of the shell 44.

Figure 8:
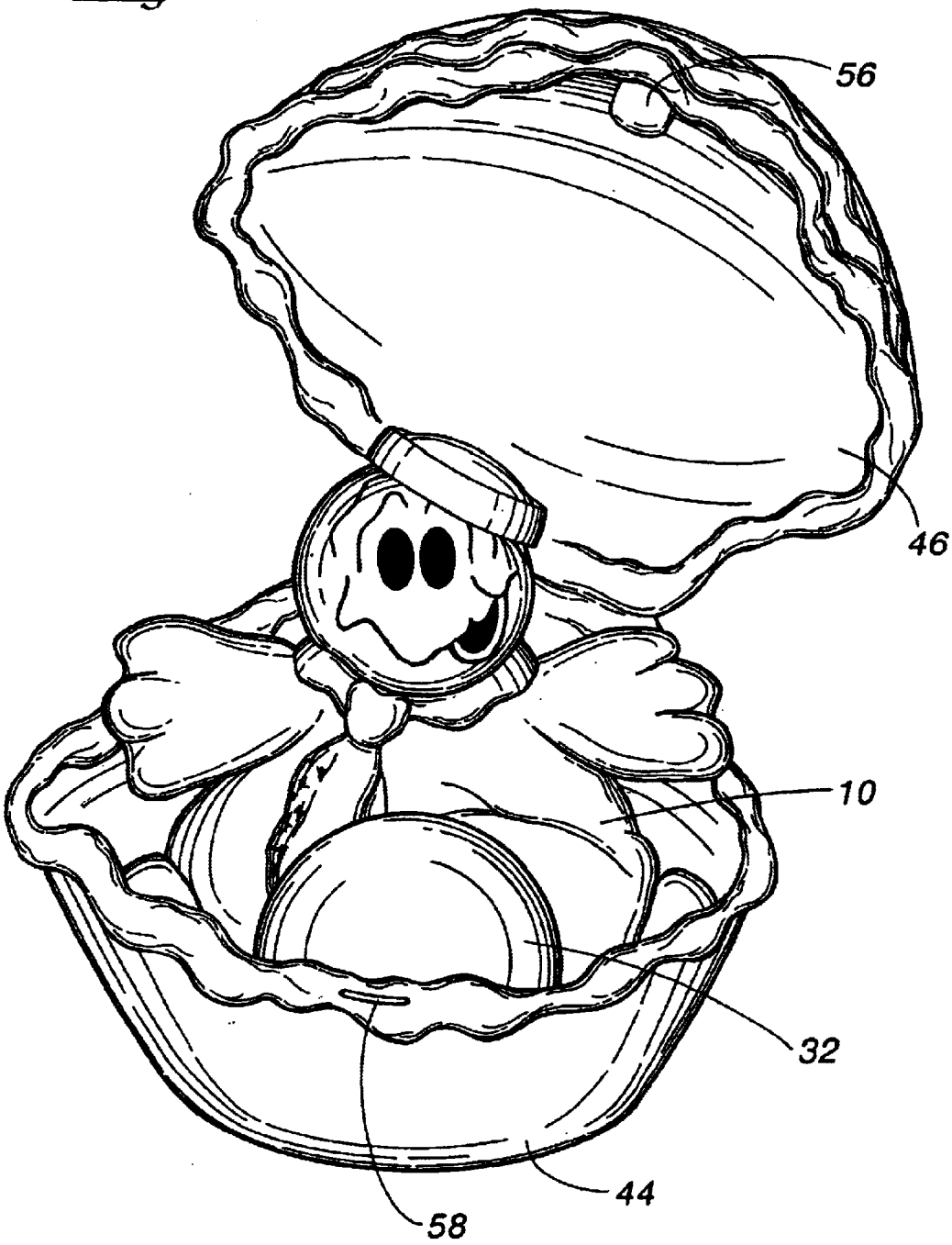
FIG. 8 illustrates the oyster toy in the shell of FIG. 6 with the pearl of FIG. 4.

As best shown in FIG. 8 the shell 44 is sized to hold both the oyster toy animal 10 and pearl 32 with room to spare for any other items that a child might like to include. Although the oyster toy animal 10, pearl 32 and shell 44 might be made in a variety of sizes, preferably the oyster toy animal 10 is of sufficient size to be easily and lovingly hugged and carried about by a young child.

An older child or teenager might prefer a smaller version suitable for dresser top, dressing table or desk top as a very friendly container for pins, jewelry, watches, or other small items.

Figure 9:
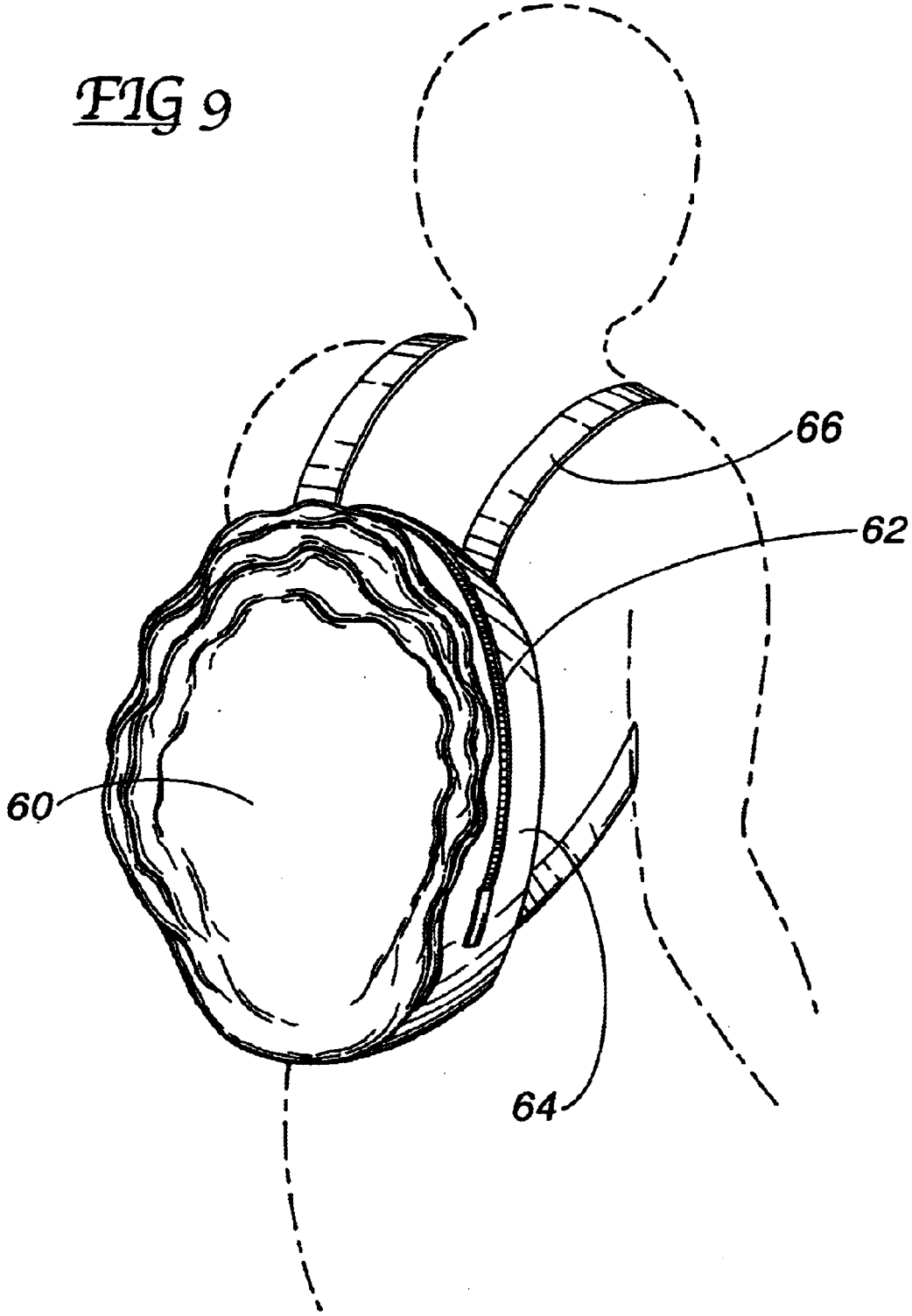
FIG. 9 illustrates a modified shell as a backpack.

FIG. 9 illustrates a modification of the shell 60 wherein the shell is fitted with a large zipper 62 and is of a more soft sculpture for use as a backpack as shown. The lower half 64 has backpack straps 66 attached thereto. As a backpack the shell 60 may contain the animal toy 10 and pearl 32 or any items a child might carry in a backpack, however, as the oyster shell with its craggy exterior the backpack has a very unique appearance.

What is claimed is:

1. A sculptured shellfish animal toy, the animal comprising a body, a head on the body, a pair of hands extending to either side of the body, a pair of feet extending to either side of the body below the hands, the head including a pair of eyes spaced apart and peering forward, a jagged mouth providing a humorous visage, and a hollow simulated pearl as an accessory to the animal, said hollow pearl being substantially smaller than the animal but of sufficient size to contain additional accessory items.

2. The sculptured shellfish animal toy of claim 1 including a hollow shell, the hollow shell including top and bottom halves that open and close to contain the animal and the pearl.

3. The sculptured shellfish animal toy of claim 2 including backpack straps affixed to the hollow shell.

4. The sculptured shellfish animal toy of claim 1 wherein said hollow pearl comprises upper and lower halves and means joining the halves together to permit opening and closing the halves.

5. A sculptured shellfish animal toy caricaturing an oyster animal comprising a body, a head on the body, a pair of hands extending to either side of the body, a pair of feet extending to either side of the body below the hands, the head including a pair of eyes spaced apart and peering forward, and a jagged mouth providing a humorous visage, a hollow shell having a craggy, irregular exterior surface shape to simulate an oyster shell and of sufficient size to contain the oyster animal, and a simulated pearl as an accessory, wherein said pearl is a hollow simulated pearl comprising upper and lower halves and means joining the halves together to permit opening and closing the halves.

6. A sculptured shellfish animal toy caricaturing an oyster animal comprising a body, a head on the body, a pair of hands extending to either side of the body, a pair of feet extending to either side of the body below the hands, the head including a pair of eyes spaced apart and peering forward, and a jagged mouth providing a humorous visage, a hollow shell having a craggy, irregular exterior surface shape to simulate an oyster shell and of sufficient size to contain the oyster animal, and a simulated pearl as an accessory, wherein the hollow shell includes top and bottom halves that open and close to contain the oyster animal and pearl.

7. The sculptured shellfish animal toy of claim 6 including backpack straps affixed to the hollow shell.

8. The sculptured shellfish animal toy of claim 5 including at least one clothing item thereon.

9. A sculptured shellfish animal toy, the animal comprising a body, a head on the body, a pair of hands extending to either side of the body, a pair of feet extending to either side of the body below the hands, the head including a pair of eyes spaced apart and peering forward, a jagged mouth providing a humorous visage, wherein the animal is a soft sculpture, at least one clothing item on the animal, a hollow shell having a craggy, irregular exterior surface shape and of sufficient size to contain the animal and at least one clothing item, and including backpack straps affixed to the hollow shell.

* * * * *